United States Patent [19]

Deuber

[11] 4,098,656

[45] Jul. 4, 1978

[54] BRIGHT PALLADIUM ELECTROPLATING BATHS

[75] Inventor: John Martin Deuber, Nutley, N.J.

[73] Assignee: Oxy Metal Industries Corporation, Warren, Mich.

[21] Appl. No.: 834,349

[22] Filed: Sep. 19, 1977

Related U.S. Application Data

[63] Continuation-in-part of Ser. No. 665,971, Mar. 11, 1976, abandoned.

[51] Int. Cl.[2] ..... C25D 3/52

[52] U.S. Cl. ..... 204/47; 204/43 N

[58] Field of Search ..... 204/43 N, 46 R, 47

[56] References Cited

U.S. PATENT DOCUMENTS

| | | | |
|---|---|---|---|
| 3,580,820 | 5/1971 | Yamamura et al. | 204/43 N |
| 3,933,602 | 1/1976 | Henzi et al. | 204/44 |
| 3,972,787 | 8/1976 | Nobel et al. | 204/47 |

FOREIGN PATENT DOCUMENTS

| | | | |
|---|---|---|---|
| 7,125,604 | 7/1971 | Japan | 204/43 N |
| 7,233,178 | 8/1972 | Japan | 204/43 N |
| 237,817 | 9/1945 | Switzerland | 204/43 N |
| 1,143,178 | 2/1969 | United Kingdom | 204/43 N |

OTHER PUBLICATIONS

Metal Finishing Guide Directory, vol. 42, pp. 358–360, 1974.

*Primary Examiner*—F.C. Edmundson
*Attorney, Agent, or Firm*—B. F. Claeboe; Richard P. Mueller; Arthur E. Kluegel

[57] ABSTRACT

The instant invention is particularly directed to a palladium electroplating bath and a method of plating therewith. The bath comprises essentially pure palladium free of alloying elements thereof and being in electrodepositable form, as well as a Class I brightener selected from the group consisting of methylene bis(napthlene sodium sulfonate), sodium benzene sulfonate, benzene sulfonimide and phenyl-sulfonic acid and a Class II organic brightener selected from the group consisting of benzaldehyde-o-sodium sulfonate, 2-butyne-1, 4-diol, 2 butene-1,4- diol and allyl sulfonate in order to improve the brightness of the deposit. The bath is particularly effective in plating palladium and alloys thereof.

5 Claims, No Drawings

BRIGHT PALLADIUM ELECTROPLATING BATHS

RELATED CASES

This application is a continuation-in-part of application Ser. No. 665,971 filed Mar. 11, 1976, now abandoned.

BACKGROUND OF THE INVENTION

This invention relates to the art of electroplating palladium and its alloys. Numerous plating baths have been proposed for this purpose. Typical baths are taught, for example, in U.S. Pat. Nos. 3,580,820; 3,933,602; and 3,972,787. The foregoing patents discuss systems containing, for example, palladium di- and tetramine halides, palladium-urea sulfite complexes, palladium dinitrite complexes, palladium tetramine nitrate or sulfate complexes, and palladium amine sulfite complexes.

It would be desirable to be able to improve the brightness of palladium or palladium alloy deposits. It would also be desirable to have available in the art a palladium electroplating bath which can be employed to obtain a bright deposit on iron, cobalt or nickel substrates which are normally passivated under alkaline conditions.

SUMMARY OF THE INVENTION

It has now been discovered that bright deposits of palladium and its alloys may be obtained from an aqueous bath containing palladium in electrodepositable form, a Class I brightener and a Class II organic brightener, if the bath is adjusted to a pH value of 4.5 to 12.

DETAILED DESCRIPTION OF THE INVENTION

The palladium is supplied to the electroplating bath of the present invention in any electrodepositable form. Stability of the bath is improved if a palladous complex is employed, such as the urea or an amine complex. Suitable examples are the palladous amine complexes with chloride, bromide, nitrite and sulfite. The palladium content of the plating bath normally is in the range of 0.1 to 50 g/l. For obtaining a strike plate a concentration of 1 to 5 g/l is preferred, and for ordinary plating a concentration of from 5 to 15 g/l and preferably about 10 g/l is preferred.

Class I and Class II nickel brighteners are described in *Modern Electroplating,* 2 ed, F. A. Lowenheim (Ed.), Pgs. 272 et seq (1963), and *Metal Finishing Guidebook & Directory,* 42 ed, Pgs. 358 et seq (1974). The Class I brighteners are generally unsaturated sulfonic compounds wherein the unsaturation is in the $\alpha$- or $\beta$-position with respect to the sulfonic group. Such compounds have the formula:

$$A—SO_3—B$$

wherein A is an aryl or alkylene group, substituted or unsubstituted, and B may be —OH, —OR, —OM, $—NH_2$, >NH, —H, —R with M being an alkali metal, ammonium or amine, and R being an alkyl group of not more than 6 carbon atoms.

The class II organic brighteners are generally unsaturated or carbonyl organic compounds. Examples are compounds containing >C=O; >C=C<; —C≡N; >C=N—; —C≡C—;

$$>N—\underset{|}{C}=S;$$

—N=N—. Species of such compounds are listed in the table at page 360 of the above mentioned Metal Finishing Guidebook.

Concentration of the individual brighteners may range from 0.0001 to 25 g/l. Some compounds may fall within the description of both Class I and Class II. Such compounds may be employed alone, but particularly improved results are obtained when a second different compound of either class is also employed.

The pH of the electroplating solution should be maintained at a value of from 4.5 to 12 in order to avoid stability problems. Values of from about 4.5 to 7.0 are preferred for strike plating with a value of about 6.5 being especially preferred. For ordinary electroplating, a pH value of from about 7 to 10 is preferred, with value of about 8.0 to 9.0 being at present the optimum. The adjustment of the pH value may readily be accomplished by the addition of any non-reactive acid or base commonly used for such purposes such as ammonium hydroxide or hydrochloric acid. The use of ammonium hydroxide assists in promoting the stability of the palladium amine complex, while the use of hydrochloric acid promotes conductivity of the solution to thereby minimize hydrogen generation at the cathode. Other commonly used non-deleterious pH adjusting agents may also be utilized, but the foregoing are preferred because of their dual function.

To further reduce the likelihood of hydrogen formation at the cathode, it is generally desirable to include additional quantities of a conductive salt. Any of the commonly used conductive salts normally employed in palladium electroplating may be used in the present bath, however, the preferred conductive salt at present is ammonium chloride. Again, the presence of ammonium promotes the stability of the palladium amine complex whereas the chloride anion improves the conductivity of the solution. Additional compounds may be employed for their conducting or buffering properties, such as partially neutralized phosphate compounds. One compound found particularly useful is ammonium monohydrogen phosphate.

The present bath may also be modified to include additives such as metallic brighteners, alloying elements and chelating elements. Suitable metallic brightening agents include cadmium, copper, gallium indium, tellurium, arsenic and zinc. Suitable chelating or sequestering agents include carboxylic acid chelating agents such as EDTA, NTA and the citrates and phosphonic chelating agents. Polyalkyl polyamines such as diethylene triamine may be added as well.

The temperature of the palladium bath should be maintained between room temperature and approximately 160° F. The preferred temperature will normally be less than 130° F in order to avoid the emission of excess ammonia from the solution. Current densities of from 0.1 to 50 ASF are suitable. For rack plating, a current density of from 5 to 15, and preferably about 10 ASF may be employed. For barrel plating, the preferred range is from 0.5 to 3 ASF.

If a low stress deposit is desired, one of the conventional stress reducing agents such as sulfamic acid, its salts or derivatives may be employed. Concentrations up to 100 g/l are suitable, with concentrations of from 25 to 75 g/l being preferred.

The following examples will serve to more fully illustrate the advantages of this invention:

EXAMPLE 1

A palladium electroplating bath was prepared as follows:

| Component | Concentration - g/l |
|---|---|
| EDTA | 20 |
| $(NH_4)_2HPO_4$ | 80 |
| $Na_2SO_3$ | 28 |
| Pd as Pd $(NH_3)_2Cl_2$ | 10 |
| Class I brightener | .005 → 2 |
| Class II brightener | .005 → 2 |

The bath pH was maintained between 8.5 and 9 and plating performed at a temperature of 120° F and a current density of 5 ASF on a brass panel.

When neither brightener was present, only hazy deposits were obtained. The Class I brightener employed was methylenebis(naphthalene sodium sulfonate) and the Class II was benzaldehyde-o-sodium sulfonate. The Class I brightener was added first and was ineffective at concentrations all the way up to 2 g/l. With the Class I brightener at 2 g/l, improved deposits of semi-bright quality were obtained at 0.02 g/l of the Class II brightener and bright deposits were obtained from 0.37 to 2.0 g/l. Similar results were obtained when 2-butene-1,4-diol was employed as the Class II brightener.

EXAMPLE 2

A further palladium plating bath was prepared as follows:

| Component | Concentration - g/l |
|---|---|
| EDTA | 30 |
| Pd as $Pd(NH_3)_2Cl_2$ | 10 |
| Class I brightener | 0.05 |
| Class II brightener | 0.0005 to 0.04 |

Under the conditions of Example 1, bright deposits were again obtained through the addition of both brighteners. The class I brightener was the same as Example 1, but 2-butyne-1,4-diol was employed as the Class II brightener.

Similar results were obtained when allylic sulfonates and ethoxylated butyne diols were substituted for the 2-butyne-1,4-diol.

EXAMPLE 3

An additional palladium plating bath was prepared as follows:

| Component | Concentration - g/l |
|---|---|
| EDTA | 30 |
| $(NH_4)_2HPO_4$ | 75 |
| Pd as Pd $(NH_3)_2Cl_2$ | 10 |
| Class I brightener | 0.05 |
| Class II brightener | 0.004 to 0.05 |

The Class I brightener was as in Example I and the Class II brightener was 2-butene-1,4-diol. Under the conditions of Example 1, bright deposits were obtained while hazy deposits were obtained without the brighteners.

In further examples, Class I brighteners such as sodium benzene sulfonate, benzene sulfonamide and phenolsulfonic acid were employed to produce generally similar results.

What is claimed is:

1. A stable aqueous electroplating bath, which comprises essentially pure palladium free of alloying elements thereof and being in electrodeposital form, and a Class I brightener selected from the group consisting of methylene bis(naphthalene sodium sulfonate), sodium benzene sulfonate, benzene sulfonamide and phenol-sulfonic acid, and a Class II organic brightener selected from the group consisting of benzaldehyde-o-sodium sulfonate, 2 butyne-1,4-diol, 2 butene-1, 4-diol and allyl sulfonate, and which exhibits a pH value of from 4.5 to 12.

2. An electroplating bath as defined in claim 1, in which there is present 0.1 to 50 grams per liter of palladium and 0.0001 to 25 grams per liter each of a Class I brightener and a class II organic brightener as set forth.

3. An electroplating bath as defined in claim 1, in which there is also present at least 1 chelating or complexing agent selected from the group consisting of carboxylic and phosphonic chelating agents which is present in an amount from 5 grams per liter up to the solubility limit of the solution.

4. An electroplating bath as defined in claim 1, in which there is included at least one conducting or buffering salt.

5. An electroplating bath as defined in claim 1, wherein the palladium is present in divalent form as an amine complex selected from chloride, bromide, nitrite and sulfite complexes.

* * * * *